US005214798A

United States Patent [19]

McLaughlin

[11] Patent Number: 5,214,798

[45] Date of Patent: Jun. 1, 1993

[54] BASEBALL GLOVE ANCHOR STRAP

[76] Inventor: Daryl L. McLaughlin, 617 Columbia Ave., Burlington, N.C. 27217

[21] Appl. No.: 878,000

[22] Filed: May 4, 1992

[51] Int. Cl.[5] ..... A41D 13/10

[52] U.S. Cl. ..... 2/160; 2/19

[58] Field of Search ..... 2/160, 170, 161 A, 19, 2/159, 162, 311, 312, 16; 273/26 C

[56] References Cited

U.S. PATENT DOCUMENTS

| | | | |
|---|---|---|---|
| 839,063 | 12/1906 | Gassaway | 2/19 |
| 1,361,565 | 12/1920 | Christy | 2/160 X |
| 3,045,815 | 7/1962 | Abildgaard | 2/114 |
| 3,232,632 | 2/1966 | Lewis | 2/160 X |
| 4,351,067 | 9/1982 | Bartels | 2/160 |
| 4,371,983 | 2/1983 | Piotti, Jr. | 2/19 |
| 4,541,127 | 9/1985 | Gould | 2/161 A X |
| 5,031,238 | 7/1991 | Hayes | 2/161 A X |
| 5,064,198 | 11/1991 | Szabo | 273/183 B X |

FOREIGN PATENT DOCUMENTS

| | | | |
|---|---|---|---|
| 406038 | 2/1934 | United Kingdom | 2/160 |
| 468296 | 7/1937 | United Kingdom | 2/160 |

*Primary Examiner*—Clifford D. Crowder
*Assistant Examiner*—Sara M. Current
*Attorney, Agent, or Firm*—Leon Gilden

[57] ABSTRACT

A baseball glove is utilized in combination with an anchor strap to maintain the baseball glove about an individual's wrist. The strap structure is formed of an L-shaped configuration having cooperating hook and loop fasteners to have a first strap directed about an individual's wrist, with a second strap secured to the associated baseball glove. A modification of the invention includes a rosin bag arrangement, as well as a wrist stiffener accommodated by the anchor strap structure.

3 Claims, 4 Drawing Sheets

BASEBALL GLOVE ANCHOR STRAP

BACKGROUND OF THE INVENTION

1. Field of the Invention

The field of invention relates to baseball glove apparatus, and more particularly pertains to a new and improved baseball glove anchor strap wherein the same is arranged to secure a baseball glove relative to an individual during use.

2. Description of the Prior Art

A baseball glove is typically worn by an individual during play, wherein during perspiration and other activity associated and expended during athletic competition, the baseball glove is subject to slippage relative to the individual's hand. The instant invention attempts to overcome deficiencies of the prior art by utilizing a baseball glove strap structure to maintain the baseball glove to the individual.

U.S. Pat. No. 4,937,882 to Hayes sets forth a baseball glove having an elongate wrist portion for securement about an individual's wrist to secure the baseball glove relative to the individual.

U.S. Pat. No. 4,665,561 to Aoki has a baseball glove mounting baseball glove finger straps to position and align the fingers within a baseball glove.

U.S. Pat. No. 4,651,345 to Latina sets forth a wrist strap construction for a baseball glove to assist in securement of the baseball glove to an individual.

As such, it may be appreciated that there continues to be a need for a new and improved baseball glove anchor strap as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of baseball glove arrangements now present in the prior art, the present invention provides a baseball glove anchor strap wherein the same provides for an L-shaped strap structure to anchor a baseball glove relative to an individual's wrist portion. As such, the general purpose of the present invention, which will be described subsequently in greater detail, is to provide a new and improved baseball glove anchor strap which has all the advantages of the prior art baseball glove constructions and none of the disadvantages.

To attain this, the present invention provides a baseball glove utilized in combination with an anchor strap to maintain the baseball glove about an individual's wrist. The strap structure is formed of an L-shaped configuration having cooperating hook and loop fasteners to have a first strap directed about an individual's wrist, with a second strap secured to the associated baseball glove. A modification of the invention includes a rosin bag arrangement, as well as a wrist stiffener accommodated by the anchor strap structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baseball glove anchor strap which has all the advantages of the prior art baseball glove constructions and none of the disadvantages.

It is another object of the present invention to provide a new and improved baseball glove anchor strap which may be easily and efficiently manufactured and marketed.

It is a further object of the present invention to provide a new and improved baseball glove anchor strap which is of a durable and reliable construction.

An even further object of the present invention is to provide a new and improved baseball glove anchor strap which is susceptible of a low cost of manufacture with regard to both materials and labor, and which accordingly is then susceptible of low prices of sale to the consuming public, thereby making such baseball glove anchor straps economically available to the buying public.

Still yet another object of the present invention is to provide a new and improved baseball glove anchor strap which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
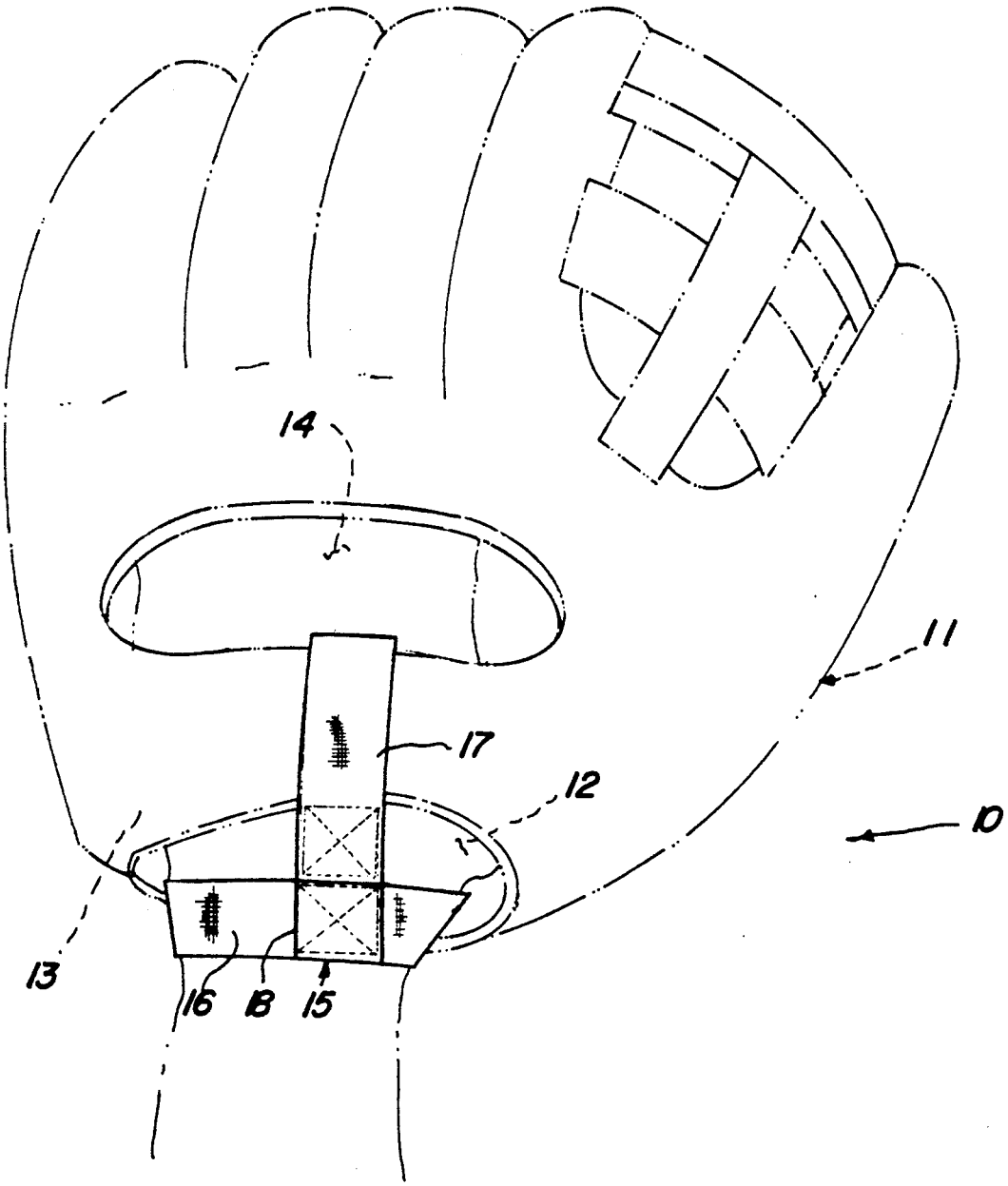
FIG. 1 is an isometric illustration of the invention in use.
Figure 2:
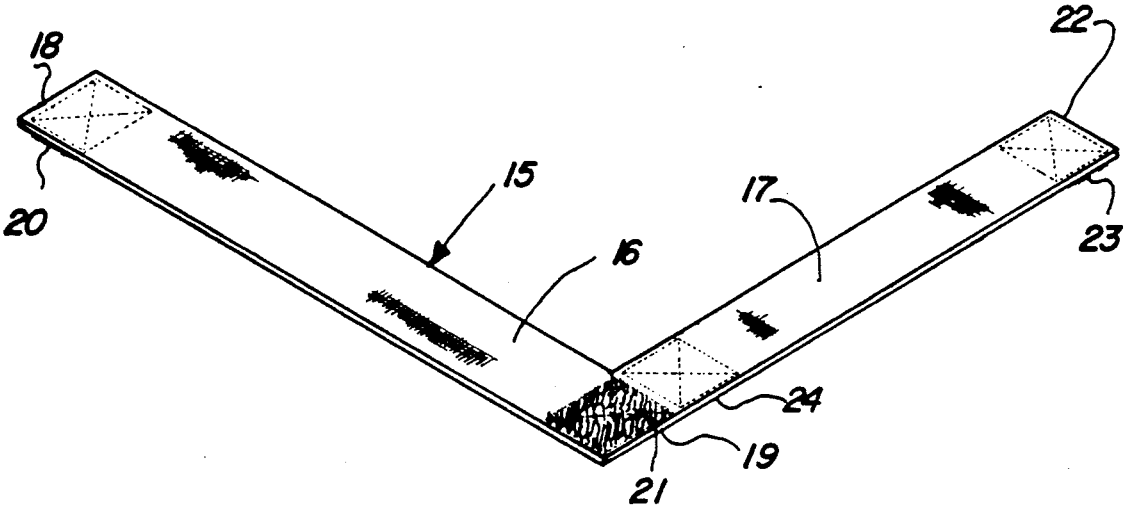
FIG. 2 is an isometric illustration of the anchor strap construction.

With reference now to the drawings, and in particular to FIGS. 1 to 9 thereof, a new and improved baseball glove anchor strap embodying the principles and concepts of the present invention and generally designated by the reference numeral 10 will be described.

More specifically, the baseball glove anchor strap arrangement as set forth in FIG. 1 includes a baseball glove 11 having a wrist opening 12 directed into the baseball glove, with a glove support web 13 extending from the wrist opening 13 to a web opening 14. The anchor strap 15 of the organization includes an L-shaped configuration (see FIG. 2) having a first elongate flexible strap 16 orthogonally mounted at its first strap second end 19 that is spaced from the first strap first end 18 to a second strap 17. The first strap includes a first hook and loop fastener patch 20 mounted to a bottom surface of the first strap 16 adjacent the first strap first end 18. A second hook and loop fastener patch 21 is mounted to a top surface of the first strap adjacent the first strap second end 19 at an intersection with the second strap 17. The second strap 17 extending orthogonally from the first strap as illustrated includes a second strap first end 22 having a third and loop fastener patch 23 mounted to a bottom surface thereof. A fourth hook and loop fastener patch 24 is mounted to a top surface of the second strap adjacent the first strap second end 19. In this manner, the third and fourth hook and loop fastener patches 23 and 24 are secured together subsequent to their encircling the glove support web 13. The first hook and loop fastener patch 20 is encircled about an individual's wrist and thereafter secured to the second hook and loop fastener patch 21 that may be of any predetermined length along the top surface of the first strap.

Figure 3:
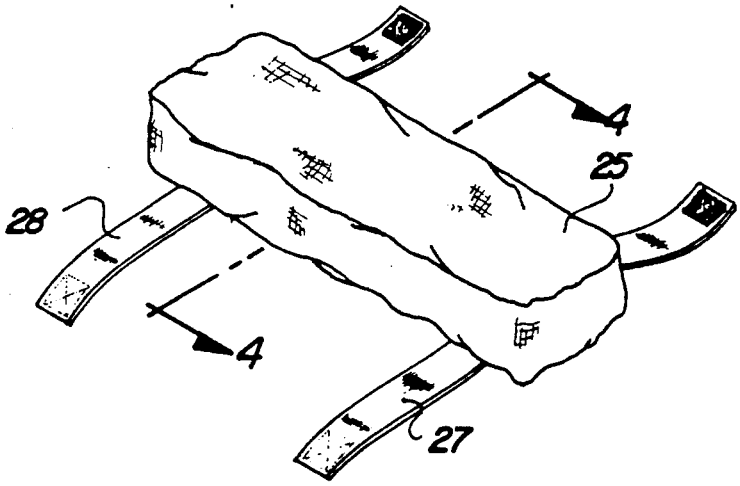
FIG. 3 is an isometric illustration of an accessory rosin bag utilized by the invention.
Figure 4:
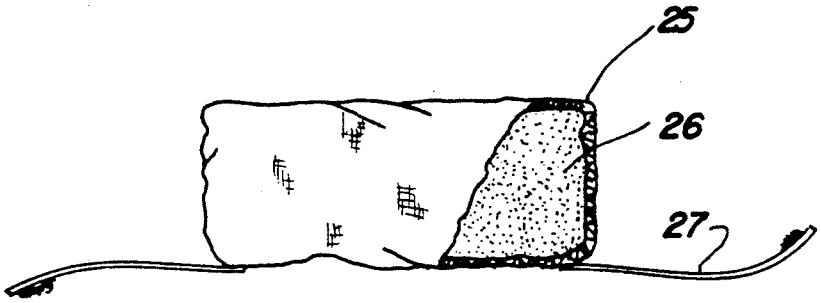
FIG. 4 is an orthographic view, taken along the lines 4—4 FIG. 3 in the direction indicated by the arrows.
Figure 5:
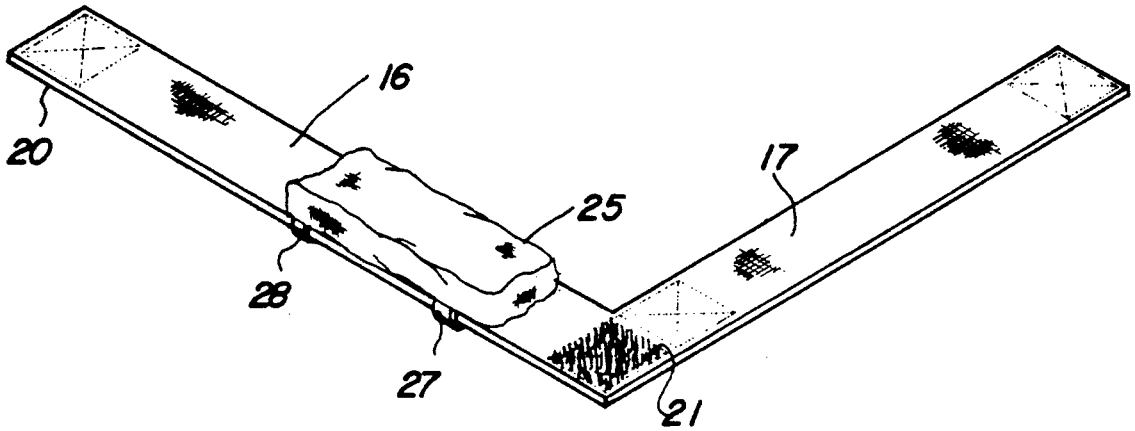
FIG. 5 is an isometric illustration of the rosin bag adjunct in use.
Figure 6:
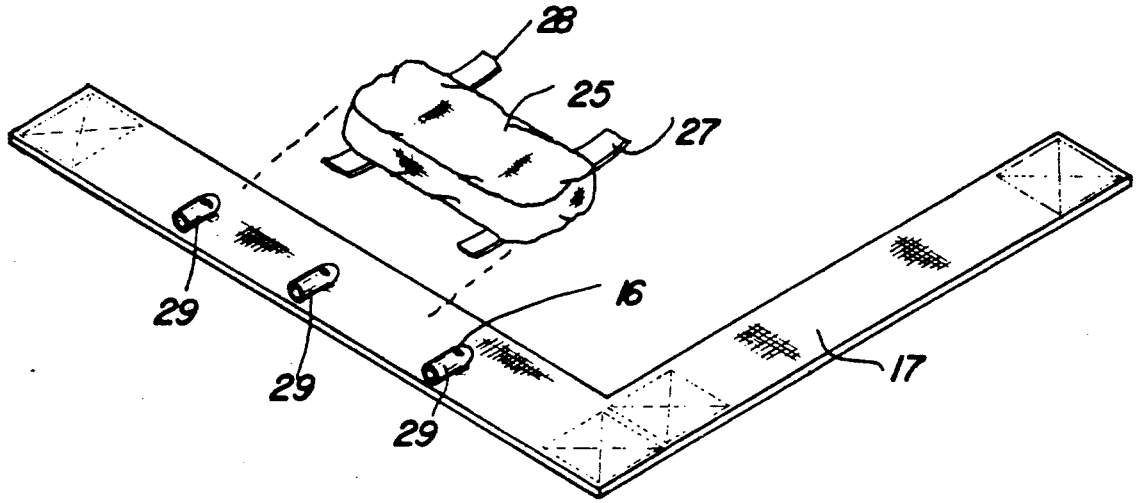
FIG. 6 is an isometric illustration of a modified anchor strap arrangement.
Figure 7:
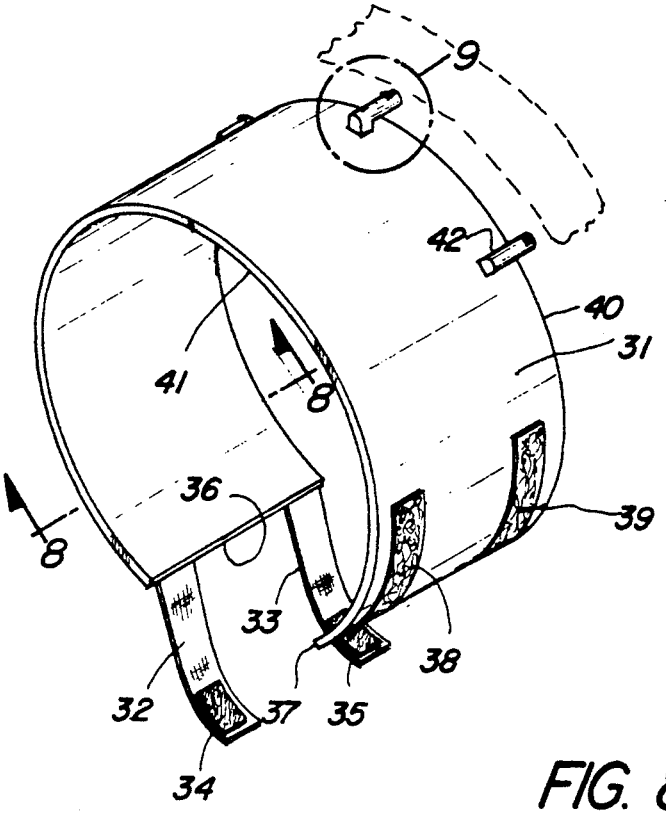
FIG. 7 is an isometric illustration of the reinforcing wrist strap utilized in association with the anchor strap, as set forth in FIG. 6.
Figure 8:
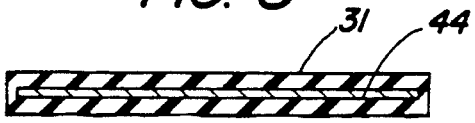
FIG. 8 is an orthographic view, taken along the lines 8—8 of FIG. 7 in the direction indicated by the arrows.
Figure 9:
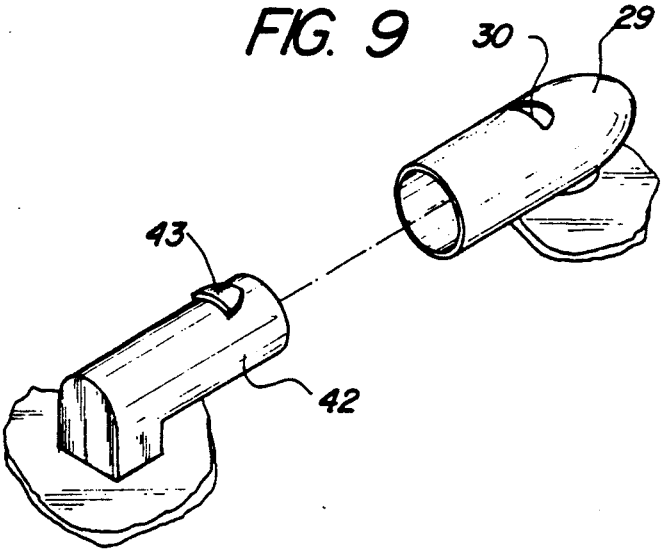
FIG. 9 is an isometric illustration of section 9 as set forth in FIG. 7.

FIG. 3 illustrates the use of a porous rosin bag 25 containing powdered rosin 26 therewithin. The rosin is utilized to enhance frictional engagement of an individual's hand relative to the glove structure, as well as to dry an individual's hand during baseball play to enhance gripping of baseballs and the like. First and second bag straps 27 and 28 mounted to a bottom surface of the rosin bag 25 at opposite ends thereof are arranged in a parallel relationship relative to one another for encircling the first strap 16 mounting the rosin bag to a top surface thereof, as illustrated in FIG. 5.

The FIGS. 6–9 illustrates a modified aspect of the invention, wherein the first strap top surface further includes a plurality of first latch tubes 29 whose axes are parallel relative to one another, and wherein the latch tubes 29 are spaced apart a predetermined spacing. The latch tubes 29 are arranged in a parallel relationship relative to the second strap 17, as illustrated. Each latch tube includes a latch tube wall slot 30 (see FIG. 9) directed through the latch tube spaced from a free distal end of each latch tube. A wrist reinforcement strap 31 is provided having a medially positioned and encapsulated reinforcing metallic web 44 that is arranged substantially coextensive within the reinforcement strap 41. The reinforcement strap includes reinforcement strap first and second connecting straps 32 and 33 extending downwardly relative to a reinforcement strap first end 36. The reinforcement strap first and second connecting straps 32 and 33 include first and second connecting strap hook and loop fastener patches 34 and 35 that in turn are selectively securable to reinforcement strap first and second hook and loop fastener patches 38 and 39 extending along a top surface of the reinforcement strap from a reinforcement strap second end 37. In this manner, encircling of an individual's wrist is available by the reinforcement strap. The reinforcement strap includes reinforcement strap first and second side edges 40 and 41, with second latch tubes 42 orthogonally oriented relative to the second side edge 41 extending therebeyond, with each of the second latch tubes 42 including a second latch tube projection 43 to be received within a respective latch tube wall slot 30 of the first latch tubes 29. In this manner, maintaining positioning of the reinforcement strap 41 relative to the anchor strap 15 is effected. It should be noted of course that the second latch tubes 42 are spaced apart the predetermined spacing as defined by the spacing of the first latch tubes 29.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A baseball glove anchor strap arrangement in combination with a baseball glove, with the baseball glove having a wrist opening, and a glove support web positioned adjacent the wrist opening, and a web opening directed through the glove support web spaced from the wrist opening, and an anchor strap, the anchor strap of an L-shaped configuration having a first strap orthogonally mounted to a second strap, the first strap arranged for securement about an individual's wrist portion and the second strap directed through the web opening encircling the glove support web, and the first strap includes a first strap first end spaced from a first strap second end, the first strap having a first strap top surface and a first strap bottom surface, and a first hook and loop fastener patch mounted to the first strap top surface adjacent the first strap first end, and a second hook and loop fastener patch mounted to the first strap bottom surface adjacent the first strap second end, and the second strap orthogonally intersecting and fixedly secured to the first strap adjacent the first strap second end, with the second strap extending from the first strap terminating in a second strap first end, and the second strap first end including a third hook and loop fastener patch mounted to a bottom surface of the second strap adjacent the second strap first end, and a fourth hook and loop fastener patch mounted to the second strap bottom surface adjacent the first strap second end, wherein the first hook and loop fastener patch is arranged for securement to the second hook and loop fastener patch, and the third hook and loop fastener patch is securable to the fourth hook and loop fastener patch, and a porous rosin bag containing powdered rosin therewithin, with the porous rosin bag including a first bag strap spaced from and parallel a second bag strap, with the first bag strap and the second bag strap mounted to a bottom surface of the porous rosin bag in a parallel relationship relative to one another, with the first bag strap and the second bag strap including respective first bag strap fastening means for encircling securement about the first strap, and the second bag strap including second bag strap fastening means for encircling securement about the first strap, the first bag strap and the second bag strap mounted in encircling relationship about the first strap, with the porous rosin bag mounted to the first strap top surface.

2. An anchor strap arrangement as set forth in claim 1 including a plurality of first latch tubes mounted to the first strap top surface projecting above the first strap top surface, with the first latch tubes arranged in a parallel relationship relative to one another spaced apart a predetermined spacing, with each of said first latch tubes including a latch tube wall slot directed through each of said first latch tubes, and a wrist reinforcement strap, the wrist reinforcement strap including a wrist reinforcement strap first end spaced from a wrist reinforcement strap second end, with at least one wrist reinforcement strap connecting strap mounted to the wrist reinforcement strap at the wrist reinforcement strap first end and securable to the wrist reinforcement strap adjacent the wrist reinforcement strap second end, the wrist reinforcement strap having a wrist reinforcement strap first side edge spaced from a wrist reinforcement strap second side edge, the wrist reinforcement strap second side edge including a plurality of second latch tubes projecting above a top surface of the wrist reinforcement strap beyond the wrist reinforcement strap's second side edge, and the second latch tube spaced apart the predetermined spacing relative to one another, and each of said second latch tubes including a second latch tube projection arranged for reception within a respective latch tube wall slot of a respective first latch tube.

3. An anchor strap arrangement as set forth in claim 2 including a reinforcing metallic web positioned within the wrist reinforcement strap and encapsulated by the wrist reinforcement strap, with the reinforcing metallic web extending substantially coextensive relative to the wrist reinforcement strap.

* * * * *